United States Patent [19]

Frye et al.

[11] 4,436,302

[45] Mar. 13, 1984

[54] APPARATUS FOR SLOWING DOWN AND PREVENTING EDGE DAMAGE ON MOVING SHEETS

[75] Inventors: Kenneth G. Frye, South Egremont, Mass.; Donald C. Fitzpatrick, Chatham, N.Y.; Arthur T. Karis, Lenox, Mass.

[73] Assignee: Beloit Corporation, Beloit, Wis.

[21] Appl. No.: 268,002

[22] Filed: May 28, 1981

[51] Int. Cl.[3] ..... B65H 29/68

[52] U.S. Cl. ..... 271/202; 271/183; 271/216

[58] Field of Search ..... 271/202, 182, 183, 265, 271/270, 229, 230, 237, 216, 203, 199; 83/88

[56] References Cited

U.S. PATENT DOCUMENTS

| | | | |
|---|---|---|---|
| 3,198,046 | 8/1965 | De Angelo | 271/202 |
| 3,232,605 | 2/1966 | Plummer et al. | 271/183 |
| 3,315,956 | 4/1967 | Lyman | 271/202 |
| 3,554,534 | 1/1971 | Grody . | |
| 3,942,786 | 3/1976 | Lauren | 271/202 |
| 4,209,956 | 7/1980 | Clayson et al. | 83/88 |
| 4,221,377 | 9/1980 | Bodewein et al. | 271/216 |
| 4,240,856 | 12/1980 | Craemer et al. | 271/203 |
| 4,272,069 | 6/1981 | Matthews | 271/182 |

*Primary Examiner*—Bruce H. Stoner, Jr.
*Assistant Examiner*—James E. Barlow
*Attorney, Agent, or Firm*—Hill, Van Santen, Steadman & Simpson

[57] ABSTRACT

Apparatus for the shingling of cut sheets of paper as they pass between conveyance on a high-speed tape conveyor and a low-speed tape conveyor is provided by a two-stage slowdown arrangement. At the first stage, a slowdown mechanism, comprising two rolls arranged respectively above and below each sheet passing through a drop-off area from the high-speed conveyor to the low-speed conveyor, serves to engage the tail portion of the sheet in a nip such that the sheet is slowed down to a speed approximately 30 to 40% of the speed of the high-speed conveyor. In this manner, the lead edge of a next succeeding sheet overlaps with the trailing edge of the nipped sheet in a drop-off area from the high-speed tape conveyor. Downstream of the slowdown rolls is a stop roll which serves to reduce the speed of the immediately preceding sheet to the speed of the low-speed tape conveyor, which is still slower than the speed of the slowdown rolls such that the sheet passing through the nip of the slowdown rolls further overlaps with the immediately preceding sheet. The possibility of lead edge damage to the sheets engaging with a stop roll for shingling is effectively eliminated.

34 Claims, 5 Drawing Figures

FIG. 3
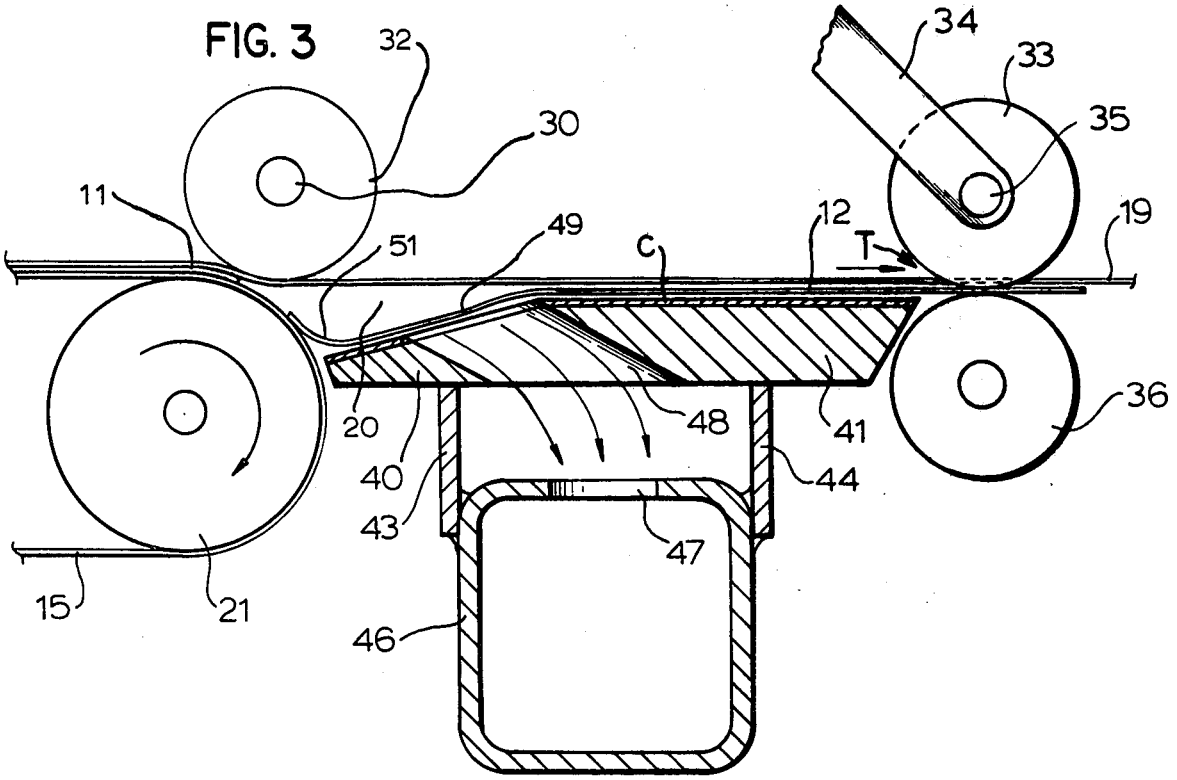
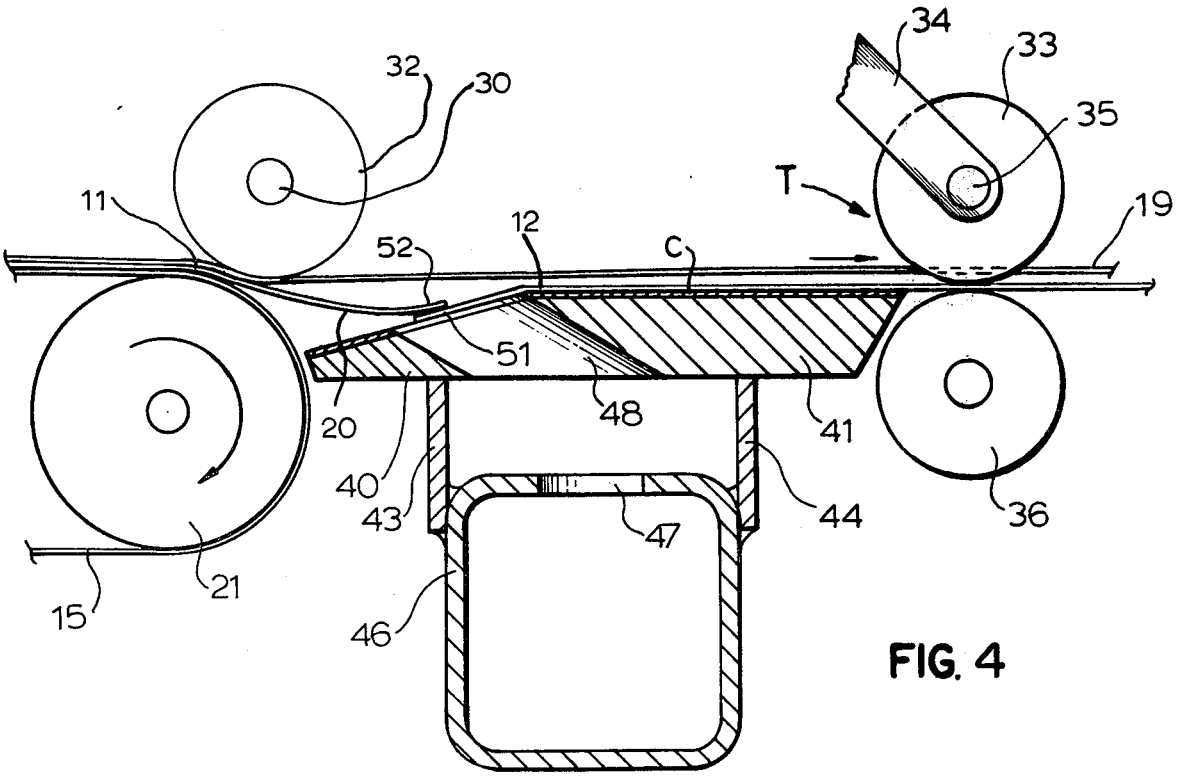
FIG. 4

APPARATUS FOR SLOWING DOWN AND PREVENTING EDGE DAMAGE ON MOVING SHEETS

BACKGROUND OF THE INVENTION

1. Field of the Invention

The invention is directed to machinery for overlapping or shingling cut sheets as they are fed to a stacking station and, more particularly, relates to a slowdown mechanism in the overlapping process to eliminate sheet lead edge contact and consequent damage in the overlapping zone and the stacking station.

2. The Prior Art

In the paper-cutting machinery field, it is common for cut sheets to be shingled enroute to a stacking or collection station. The overlapping or shingling operation is usually performed by high and low-speed tape systems. The speed of the leading sheet is reduced as it is fed onto the low-speed tape by some suitable means, such as a stop roll. One example of this stop roll shingling process is illustrated in U.S. Pat. No. 3,554,534, where a snap down roll is also disposed upstream of the stop roll to deflect the tail ends of sheets passing onto the low-speed tape down and out of the way of the next oncoming sheet being delivered by the high-speed tape system.

A serious drawback with presently known sheet overlap systems is that, as sheet delivery speed goes up, it becomes impossible to overlap sheets enough to eliminate lead edge damage. At high sheeter speeds, approximately 400–1500 fpm, lead edge damage occurs not only in the collection or stacking station but also at the stop rolls in the overlap area. In the case of the stop rolls, sheets being delivered at high speed tend to impact against the low-speed stop roll which can cause wrinkling in the sheets and may even lead to jam-ups in the sheet delivery system.

The present invention is directed to apparatus for effectively eliminating the problem of lead edge damage even at high sheet speeds, either in the overlap area and/or the collection station.

SUMMARY OF THE INVENTION

A two-stage shingling operation is performed on cut sheets as they pass from a high-speed tape system to a low-speed tape conveyor leading to a stacker. At the end of the high-speed tape conveyor, a drop-off area occurs where the leading edge of a sheet being passed from a bottom tape of the high-speed tape conveyor is overlapped onto the trailing edge of an immediately preceding sheet.

In accordance with a first embodiment, a snap-down roll directs the leading edge of the sheet down on an angle on top of the trailing edge of the preceding sheet. When a sheet trailing edge comes to this drop-off area, it is snapped down, due to a bend formed in the sheet, thus minimizing the chance of a collision with the lead edge of the next sheet. A vacuum box system is preferably arranged at the drop-off area to assist in this snap down process.

The initial overlapping operation is caused by a slowdown assembly positioned between the drop-off area and the low-speed tape conveyor in which tail stopper nip wheels are provided for nipping the trailing portion of each sheet against a driven slowdown roll, thus forcing the sheet to assume the speed of the slowdown roll. The slowdown roll is preferably rotated approximately 30 to 40% slower than the high-speed tape conveyor, but still substantially faster than the low-speed tape system. With the nip wheels down against the sheet, the sheet is slowed down sufficiently for the next subsequent sheet to overlap with it at the drop-off area. An additional feature of the slowdown assembly is that a sheet may be stopped altogether to allow upstream sheet flow to make up a gap in the line arising from previous rejection of a defective sheet. While being nipped in the slowdown assembly, the lead edge of the sheet is driven over the immediately preceding sheet for further overlapping due to a stop roll engagement on the immediately preceding sheet which brings that sheet down to the speed of the lowspeed tape conveyor.

In accordance with a second embodiment, the snapdown roll mechanism is replaced by a kickdown device in the form of a bar element mounted on a rocker arm supporting the tail stopper nip wheels. Upon activation of the slowdown assembly, the bar element is lowered along with the nip wheels to positively direct the leading edge of the incoming sheet away from the upper tape of the high speed tape conveyor and against a support plate in the drop-off area on top of the trailing edge of the slowed down sheet for overlapping.

A sheet detection system serves to trigger actuation of the tail stopper nip wheel so that each sheet is nipped approximately in the trailing third portion of the sheet. Thus, each sheet is constrained and controlled immediately before, during, and after cross-over between the high-speed tape conveyor and the low-speed tape system and shingling of the sheets is performed in two stages, which minimizes the risk of lead edge damage in engagement with the stop roll.

BRIEF DESCRIPTION OF THE DRAWINGS

FIG. 3 is an enlarged cross-sectional side elevational view illustrating the drop-off area in FIG. 1 just before a sheet enters.

FIG. 4 is an enlarged cross-sectional side elevational view illustrating the drop-off area in FIG. 1 as the leading edge of a sheet enters.

DESCRIPTION OF THE PREFERRED EMBODIMENT

Figure 1:
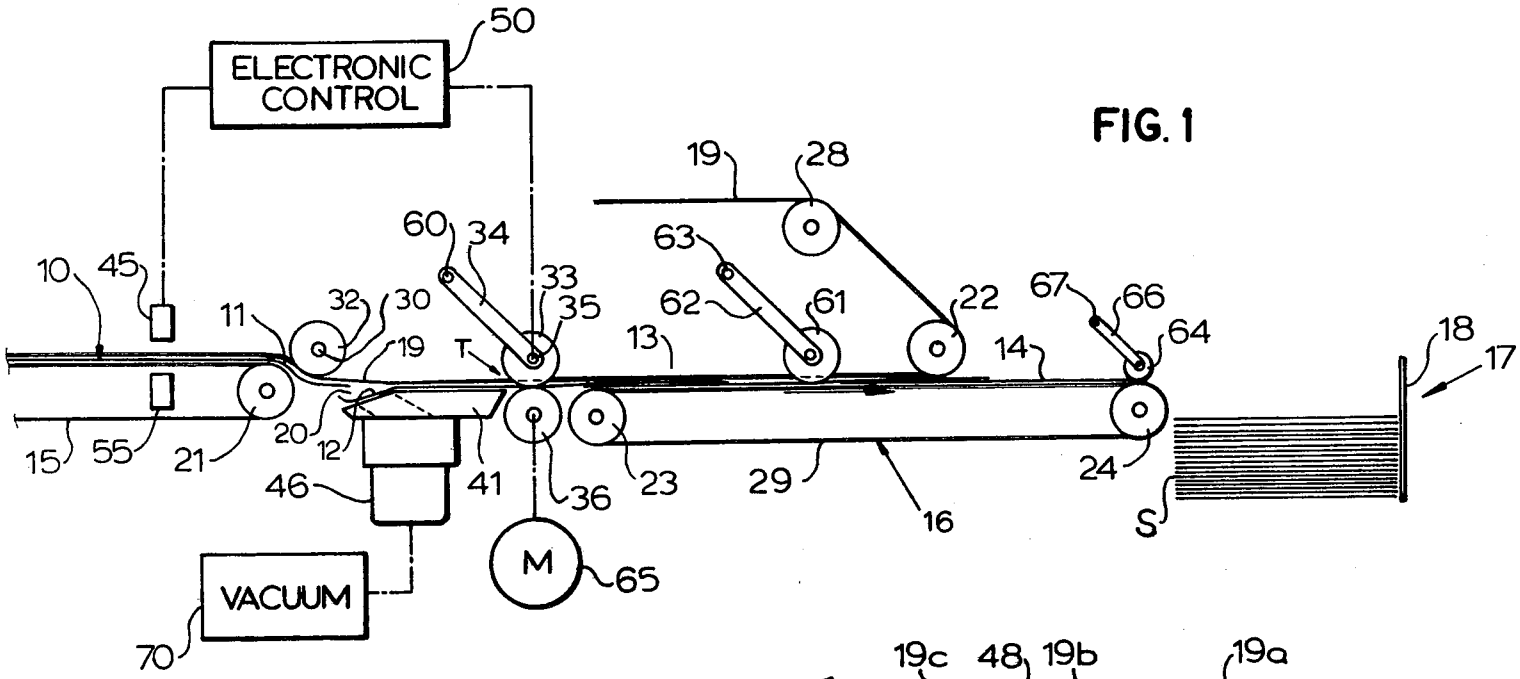
FIG. 1 is a schematic side elevational view illustrating the two-stage slowdown assembly of the present invention.

With reference to FIG. 1, there is illustrated a series of sheets, such as paper sheets 11, 12, 13, and 14 which have been cut by a knife into individual sheets upstream of FIG. 1 and are being passed in a seriatim flow. A high-speed tape conveyor system 10 having a lower tape means 15 supported at one end by rolls 21 and at the other end by similar rolls not shown, and an upper tape means 19, supported therealong by rolls 22 and 28 and additional rolls not shown, serves to convey the cut sheets at high speed. The high-speed tapes 15 and 19 convey the sheets at speeds between 400 and 1500 feet per minute. The upper tape extends further rightward in FIG. 1 of the turnaround roll 21 from the bottom tape 15. Immediately downstream of the turnaround roll 21, there is defined a drop-off area 20 where the sheets commence to cross-over from the high-speed tape system to a low-speed tape conveyor 16. The low-speed conveyor comprises a bottom tape 29 supported by end rolls 23 and 24 for driving sheets at approximately 200–300 fpm (depending on the grade and weight of the paper) to a stacking station 17. At the stacker 17, sheets are piled into a stack S against a stop plate 18.

During cross-over, sheets are shingled or overlapped in a two-stage operation in accordance with the instant invention.

Figure 2:
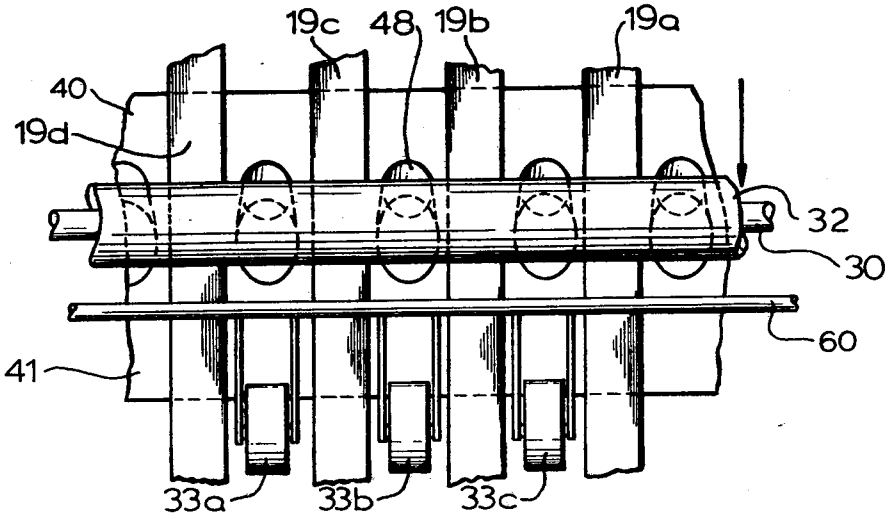
FIG. 2 is a fragmentary plan view illustrating the dropoff area in FIG. 1.

Over the drop-off area 20, there is a snap down roll 32 having a lower surface contiguous with the upper surface of the upper tape 19. This snap down roll may be provided in the manner disclosed in U.S. Pat. No. 3,554,534. With reference to FIGS. 2–4, there is mounted beneath the drop-off area 20 a support plate 41 for supporting the flow of sheets from below. The support plate 41 is formed at its upstream edge with a tapered surface 40, preferably formed with a horizontal incline of between 5 and 25 degrees. The upper surface of the support plate 41 is covered by a sheet C of conducting material, such as copper, in order to avoid disruptions in the sheet flow into the drop-off area due to static electricity. Intermediate along the tapered surface 40 is a downwardly directed opening 48 leading to a plenum chamber defined by surface walls 43 and 44. The plenum space connects with an opening 47 formed in a suction box 46 coupled to a vacuum source 70. The suction force from the vacuum box 46 is used to snap down and control the trail ends of sheets passing through the drop-off area 20. FIG. 3 illustrates a sheet 12 wherein the forward edge has already passed to the right and the trailing edge 51 and trailing portion 49 are pulled downwardly against the inclined surface 40 such that the edge 51 deflects downwardly in a gentle, curving fashion as shown. This arrangement allows the trailing edge 51 of each sheet to drop onto the inclined surface 40 without any sudden change of direction or momentum, as would occur if drop-off was vertical. Snap down of the trailing sheet edge 51 is assisted by the suction force provided through vacuum opening 48; however, this snap-down against the incline surface 40 also inherently occurs due to convex bending of the sheet edge as it drops down off the high-speed bottom tape 15 along the roll 21 profile.

The trailing edge 51 of the sheet lying flush against the incline surface 40 prevents collision thereagainst by a lead edge 52 of a next sheet so that the sheet edges can be readily overlapped as shown in FIG. 4. This trailing sheet edge 51 acts as a valve over the vacuum opening 48, such that the lead edge 52 of the next sheet is able to extend out horizontally at first in the drop off area 20 as it leaves the high-speed tape 15 before being dipped angularly downward by snap down roll 32 toward the support plate incline 40 and onto the trail edge 51 of the preceding sheet. A corrugation form at the delivery end of the tape 15 may possibly be added to assist the initial horizontal extension of sheet leading edges 52. Sheet flow commences a first-stage overlap in the drop-off area 20 due to a downstream tailstopper or slowdown assembly T which slows each sheet enough to allow its trailing edge 51 to be overlapped by the lead edge 52 of the following sheet.

The slowdown mechanism T is mounted immediately downstream of the support plate 41 but upstream of the low-speed tape 29 leading to the stacker 17. As shown in FIGS. 1, 3, and 4, the slowdown assembly T comprises a tailstopper or nip wheel means 33, which is rotatably supported on a laterally extending shaft 35 supported, preferably in spring-loaded fashion, on pivot arm means 34. The pivot arm means 34 is rotatably movable about a pivot shaft 60 by suitable means such that the tailstopper wheel means 33 is movable from an at rest position loosely spaced over the upper surfaces of the sheets to an operative position pressing the sheets against a driven roller means 36 supported for rotation beneath the sheets. The driven roll means 36 serves as a slowdown roll driven by a motor means 65 at a speed which is preferably 30 to 40% of the high speed tape system. When the nip wheel 33 is moved downward, it nips a sheet against the slowdown roll 36 which slows the sheet. This allows the trail edge of the sheet to be initially overlapped in the drop-off area 20 by the lead edge of the next succeeding sheet. The nipped sheet tends to straighten out, rather than buckle, due to the flow inertia of the sheet.

Operative movement of the tailstopper wheel arrangement 33 is controlled by a sheet detection means, such as an electric eye 45 which is triggered by light from a light source 55 when gaps between adjacent sheets occur in the sheet flow. The detection means 45 supply a signal to an electronic control 50 which activates a suitable drive means to depress the tailstopper wheel means 33 about the pivot shaft 60. The electronic control 50 is set so that the tailstopper wheel arrangement 33 nips the upper surface of a sheet approximately in the trailing third portion of the sheet but still downstream from the very trailing edge of the sheet such that sufficient tail area extends upstream from the slowdown mechanism to permit overlapping with the next succeeding sheet. Control of the detection means may be set with a speed compensated timing circuit for actuation in the manner disclosed in the commonly assigned U.S. Pat. No. 4,365,797.

The slowdown mechanism rollers 33 and 36 also serve to decelerate the flow of sheets so that sheets do not tend to ram against a downstream stop roll 61. The stop roll 61 is driven in contiguous relation with the upper surface of the low-speed tape means 29. The stop roll 61 is supported for rotation at the lower end of an arm 62 which is pivoted from a pivot shaft 63. As each sheet, such as shown by sheet 13, enters the nip formed between the stop roll 61 and the upper surface of the low-speed tape 29, the speed of the sheet is immediately reduced to the speed of the low-speed tape conveyor. However, the slowdown roll 36 speed is chosen to be faster than the speed of the low-speed tape conveyor. Thus, a second-stage, further overlapping of sheets occurs. As each sheet is passed through the slowdown mechanism nip, it is able to substantially overtake the preceding sheet delayed by engagement with the stop roll 61 and now being driven at low-speed tape speed.

The shingled sheets, shown by sheets 13 and 14, are then passed along on the low-speed tape conveyor means 29 to a kick-off roller means 64. The kick-off roller 64 is mounted on an arm 66 which is pivoted on a shaft 67 and serves to guide the sheets out over the stack S into engagement with the stop wall 18 and subsequent piling on top of one another in the stacking station 17.

It is also within the contemplation of the instant invention that the nip wheel means 33 can be depressed to hold a sheet in the slowdown mechanism to allow subsequent sheets to fill in a gap in the sheet flow resulting from removal of a defective sheet that has been discharged or rejected at some time during the flow from the upstream sheet or knife. Such stationary holding of a sheet in this manner is intended to last only for a predetermined time to avoid undue space between the stopped sheet and the subsequent sheet, so that, although the amount of overlap of the stopped sheet with the immediately preceding sheet decreases, the sheets still remain in order to prevent jam-up in the sheet flow and the stopped sheet may be overlapped to some extent in the drop-off area 20.

As illustrated in FIG. 2, the tailstopper wheel arrangement 33 actually comprises a plurality of individual wheels or rolls 33*a*, 33*b*, 33*c*, etc., axially spaced along the shaft 35. Similarly, the upper high-speed tape 19 actually comprises a series of space-apart ribbons 19*a*, 19*b*, 19*c*, 19*d*, etc., between which extend the individual knockdown wheel rolls for engagement with the upper surfaces of the sheets. The stop roll 61 may be suitably grooved to allow clearance for the high-speed tapes so that they do not engage the roll. As illustrated in FIG. 2, the snap down roll 32 may be a continuous member underneath which rides the various high-speed tapes 19*a*, 19*b*, etc.

Figure 5:
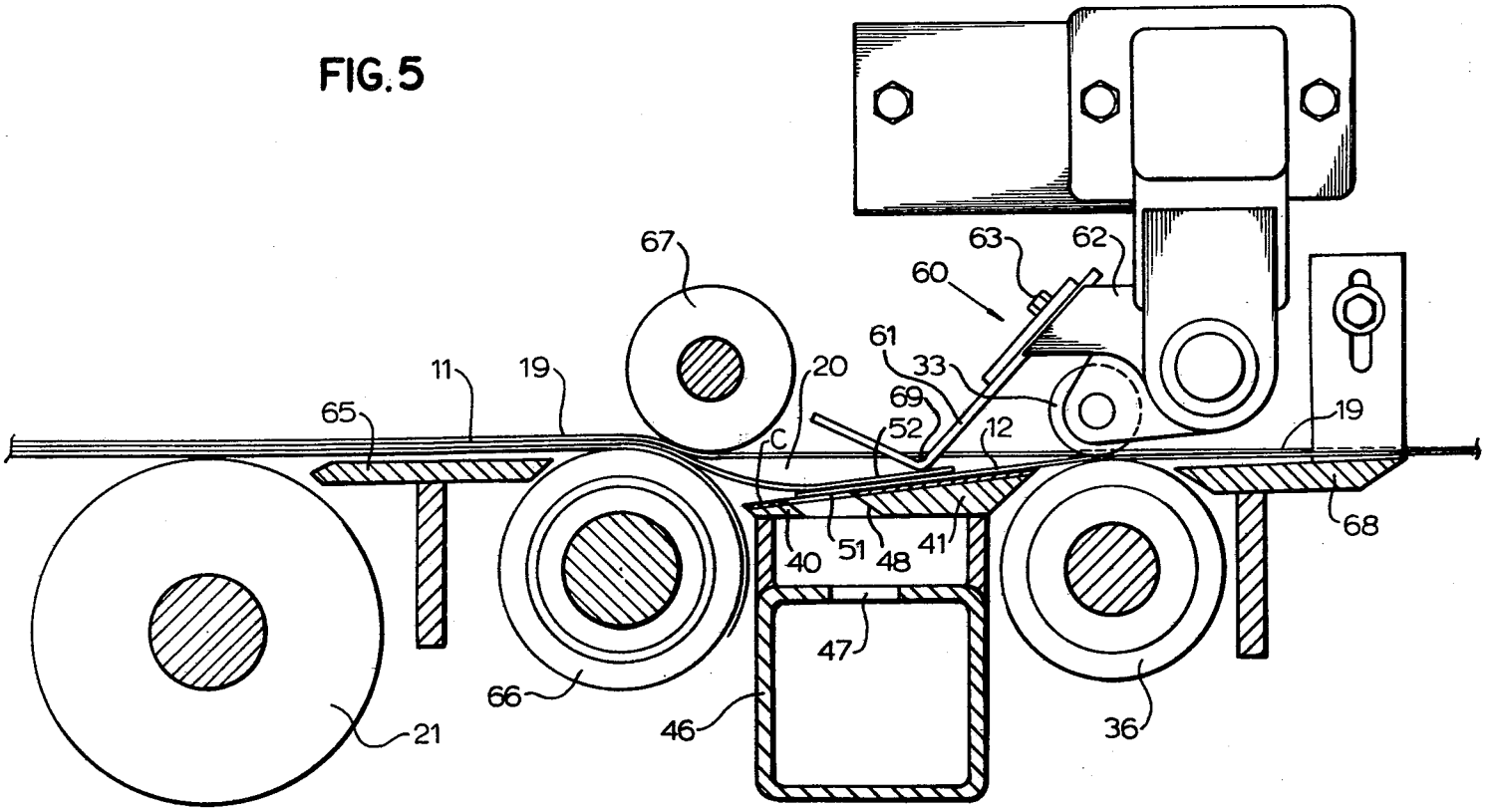
FIG. 5 is an enlarged cross-sectional view illustrating a drop-off area as the leading edge of a sheet enters a two-stage slowdown assembly, wherein a kickdown device is used in place of a snapdown roll in accordance with a further embodiment of the present invention.

FIG. 5 illustrates a further embodiment of the invention wherein recurring elements from the previous embodiment retain their reference numerals. In this embodiment, the snap down roll is replaced by a kickdown device 60 in the form of a series of generally L-shaped bar elements 61 mounted to the pivot or rocker arms supporting the individual tailstopper rolls 33. The base end of each kickdown bar 61 is fixedly secured to a support bracket 62 by bolt means 63, each bracket 62 being attached at its other end to a corresponding pivot arm.

The upper high speed tape 19 conducts the cut sheet 11 rightward of the turnaround roll 21 over a platform 65 and through a nip between upper and lower high speed rolls 66 and 67 into the drop-off area 20 for first-stage overlapping. As described above, the drop-off area 20 contains the support plate 41 and attendant suction box means for assisting snap down of the trailing edge 51 of the preceding sheet 12 to lie flush with the support plate incline 40. For purposes of this embodiment, the entire upper surface of the support plate 41 is formed with the horizontal incline 40. Downstream of the drop-off area 20 is the slowdown mechanism T, followed by a further platform 68 leading to the low-speed tape 29 and stop roll means 61 for second-stage overlapping as described above.

When the slowdown mechanism T is activated, as shown in FIG. 5, nip wheels 33 press sheet 12 against the slowdown roll 36 which slows the sheet. Simultaneously with lowering of the nip wheels 33, the kickdown bars 61 are passed from their at rest position above the upper tape 19 to a position beneath the tape overlying the support plate 41. As corresponding corner regions 69 of the bars 61 pass between the upper tape ribbons, they engage with the leading edge 52 of the incoming sheet 11 to positively separate it from the high-speed tape 19 and direct it down onto the trailing edge 51 of the preceding sheet 11. This kickdown movement also knocks down the trailing portion of the sheet 12 being overlapped, assuring a positive cross-over by the incoming sheet 11.

Thus, in accordance with the present invention, there is provided means for almost complete control and constrainment of sheets during cross-over between the high-speed tape conveyor and the low-speed tape conveyor in a sheeting machine and two-stage shingling of the sheets is afforded.

Although various minor modifications may be suggested by those versed in the art, it should be understood that we wish to embody within the scope of the patent warranted hereon all such modifications as reasonably and properly come within the scope of our contribution to the art.

We claim as our invention:

1. Apparatus for overlapping cut size sheets in seriatim flow comprising:

a high-speed tape conveyor system and a low-speed tape conveyor system, said high-speed tape conveyor having a delivery end facing a receiving end of said low-speed tape conveyor, said high and low-speed tape conveyors having sheet carrying surfaces with said sheet carrying surface of said low-speed tape conveyor being disposed at a level substantially lower than said high-speed conveyor sheet carrying surface, a drop-off area through which sheets pass from said high-speed delivery end to said low-speed receiving end containing a stationary support plate onto which sheets fall from said high-speed delivery end, a slowdown assembly between said support plate and said low-speed receiving end comprising a slowdown roll means aligned with said low-speed tape conveyor, driven by a constant-speed motor means to run at less than the speed of said high-speed tape conveyor but greater than said low-speed tape conveyor speed, and a nip wheel means for forming a nip with said slowdown roll means through which sheets pass to said low-speed tape conveyor, said nip wheel means being mounted for movement toward and away from said slowdown roll means to selectively press each sheet into driving engagement with said slowdown roll means for slowing so that the trailing edge of each nipped sheet is overlapped in said drop-off area by the leading edge of the next succeeding sheet falling toward said support plate, and a stop roll means rotatably disposed to press sheets leaving said slowdown assembly onto said sheet carrying surfaces of said low-speed tape conveyor such that said sheets assume the speed of said low-speed conveyor, whereby the leading edge of each sheet passing through said slowdown assembly nip further overlaps with the trailing edge of the immediately preceding sheet delayed by engagement with said stop roll means.

2. The apparatus of claim 1, wherein said high-speed tape conveyor travels at about 400 to 1500 feet per minute.

3. The apparatus of claim 2, wherein the peripheral speed of said slowdown roll means is 30 to 40 percent slower than the speed of said high-speed tape conveyor.

4. The apparatus of claim 1, further comprising a kickdown means mounted for movement with said nip wheel means for positively separating the leading edge of each sheet entering said drop-off area from said high speed tape conveyor and directing each said sheet toward said support plate onto the trailing edge of each nipped sheet.

5. The apparatus of claim 4, wherein said kickdown means comprises a plurality of bar elements extending upstream of said nip wheel means and overlying said support plate.

6. The apparatus of claim 1, further comprising a snap down roll means mounted above said support plate for deflecting the leading edge of each sheet being passed from said delivery end of said high-speed conveyor downward onto said support plate.

7. The apparatus of claim 6, further comprising an opening in said support plate facing generally upward in said drop-off area and connected to a vacuum-supply means for snapping down the trailing edge of each sheet onto said support plate.

8. The apparatus of claim 7, wherein said vacuum-supply means produces a continuous suction force through said opening, said opening being valved by movement of the trailing edge of each sheet thereover such that the leading edge of each next succeeding sheet passes initially horizontally outward off said high-speed delivery end for clear overlapping onto the trailing edge of each sheet nipped in said slowdown assembly.

9. The apparatus of claim 7, wherein said support plate has an inclined surface in which said opening is mounted.

10. The apparatus of claim 9, wherein the incline of said inclined surface is between 5 and 25 degrees from the horizontal.

11. The apparatus of claim 1, further comprising a kickdown means mounted for movement with said nip wheel means for positively separating the leading edge of each sheet entering said drop-off area from said high speed tape conveyor and directing each said sheet toward said support plate onto the trailing edge of each nipped sheet.

12. The apparatus of claim 11, further comprising an opening in said support plate facing generally upward in said drop-off area and connected to a vacuum-supply means for snapping down the trailing edge of each sheet onto said support plate.

13. The apparatus of claim 12, wherein said vacuum-supply means produces a continuous suction force through said opening, said opening being valved by movement of the trailing edge of each sheet thereover such that the leading edge of each next succeeding sheet passes initially horizontally outward off said high-speed delivery end for clear overlapping onto the trailing edge of each sheet nipped in said slowdown assembly.

14. The apparatus of claim 12, wherein said support plate has an inclined surface in which said opening is mounted.

15. The apparatus of claim 1, further comprising automatic control means for selectively depressing said nip wheel means toward said slowdown roll means to nip sheets in said slowdown assembly.

16. The apparatus of claim 15, wherein said control means depresses said nip wheel onto the trailing third portion of each sheet.

17. The apparatus of claim 15, wherein said nip wheel means is selectively depressed by said control means to substantially slow the nipped sheet until the next succeeding sheet is ready to overlap in said drop-off area.

18. The apparatus of claim 1, further comprising a snap down roll means mounted above said support plate for deflecting the leading edge of each sheet being passed from said delivery end of said high-speed conveyor downward onto said support plate.

19. The apparatus of claim 1, further comprising an opening in said support plate facing generally upward in said drop-off area and connected to a vacuum-supply means for snapping down the trailing edge of each sheet onto said support plate.

20. Apparatus for two-stage overlapping of cut-size sheets passing in seriatim flow between a high-speed tape conveyor system and a low-speed tape conveyor system, said low-speed tape conveyor system having sheet carrying surfaces disposed at a level substantially lower than sheet carrying surfaces for said high-speed tape conveyor system, comprising:

a drop-off area having a support plate generally level with the carrying surfaces of said low-speed conveyor and onto which sheets drop in transit between a delivery end of said high-speed conveyor and a receiving end of said low-speed conveyor and having a slowdown assembly having upper nip wheel and lower slowdown roll means defining therebetween a nip for receiving sheets therethrough passing from said support plate to said low-speed conveyor, said lower slowdown roll means being aligned with the carrying surfaces of said low-speed conveyor and driven by a constant-speed motor means to run at a speed less than the speed of said high-speed tape conveyor but greater than the speed of said low-speed conveyor, said upper nip wheel means being mounted to selectively nip each sheet against said lower roll means for delaying the trailing edge of the nipped sheet on said support plate such that the leading edge of the next succeeding sheet overlaps onto the nipped sheet trailing edge as the next succeeding sheet passes from the delivery end of said high-speed tape conveyor system, and stop roll means rotatably disposed over said low-speed sheet carrying surfaces to slow each sheet down to the speed of said low-speed tape conveyor system while the next succeeding sheet is being nipped in said slowdown assembly, thus causing the next succeeding sheet to further overlap the stop roll slowed sheet as the next succeeding sheet is passed through said slowdown assembly nip.

21. The apparatus of claim 20, wherein said high-speed tape conveyor travels at about 400 to 1500 feet per minute.

22. The apparatus of claim 20, wherein the peripheral speed of said slowdown roll means is 30 to 40 percent slower than the speed of said high-speed tape conveyor.

23. The apparatus of claim 20, further comprising a snap down roll means mounted above said support plate for deflecting the leading edge of each sheet being passed from said delivery end of said high-speed conveyor downward onto said support plate.

24. The apparatus of claim 23, further comprising an opening in said support plate facing generally upward in said drop-off area and connected to a vacuum-supply means for snapping down the trailing edge of each sheet onto said support plate.

25. The apparatus of claim 20, further comprising automatic control means for selectively depressing said nip wheel means toward said slowdown roll means to nip sheets in said slowdown assembly.

26. The apparatus of claim 25, wherein said control means depresses said nip wheel onto the trailing third portion of each sheet.

27. The apparatus of claim 20, further comprising a kick-down means mounted for movement with said nip wheel means for positively separating the leading edge of each sheet entering said drop-off area from said high speed tape conveyor and directing each said sheet toward said support plate onto the trailing edge of each nipped sheet.

28. The apparatus of claim 27, wherein said kickdown means comprises a plurality of bar elements extending upstream of said nip wheel means and overlying said support plate.

29. The apparatus of claim 27, further comprising an opening in said support plate facing generally upward in said drop-off area and connected to a vacuum-supply means for snapping down the trailing edge of each sheet onto said support plate.

30. A method for overlapping cut-size sheets passing in seriatim flow from a relatively high-speed tape conveyor system to a relatively low-speed tape conveyor system, wherein said low-speed tape conveyor has sheet carrying surfaces at a level substantially lower than sheet-carrying surfaces for said high-speed tape conveyor system, comprising:

dropping sheets off a delivery end of said high-speed tape conveyor system onto a support plate such that the leading edge of each sheet extends horizontally outward initially and then gently curves toward said support plate and the trailing edge of each sheet bends off said delivery end so as to be snapped down flush with said support plate, delaying each sheet downstream of said support plate by passing each sheet through a slowdown nip formed at the level of the carrying surfaces of said low-speed conveyor by upper and lower roll means such that the trailing edge of each sheet is overlapped by the leading edge of the next succeeding sheet as the leading edge of the next succeeding sheet drops off said high-speed delivery end, slowing each sheet down to the speed of said low-speed tape conveyor system after each sheet has passed through said slowdown nip with a stop roll means rotatably disposed over said low-speed tape conveyor system, and directing each sheet through said slowdown nip at a constant speed less than speed of said high-speed tape conveyor system but greater than the speed of said low-speed tape conveyor such that the trailing edge of each slowed sheet is further overlapped by the leading edge of the next succeeding sheet passing through said slowdown nip.

31. The method of claim 30, further comprising:

driving said lower roll means in continuous rotation and selectively intermittently causing said upper roll means to depress against said lower roll means for nipping each sheet in driving engagement with said driven lower roll means.

32. The method of claim 31, further comprising:

controlling depression of said upper roll means so as to nip each sheet in its trailing third portion.

33. The method of claim 30, further comprising:

applying a suction force through said support plate to assist snapping down thereagainst of the trailing edge of each sheet.

34. The method of claim 30, further comprising:

positively knocking down the leading edge of each succeeding sheet down onto said support plate to overlap with the trailing edge of each preceding sheet.

* * * * *